US007768366B1

(12) United States Patent
Patton et al.

(10) Patent No.: US 7,768,366 B1
(45) Date of Patent: Aug. 3, 2010

(54) NANOPARTICLES AND CORONA ENHANCED MEMS SWITCH APPARATUS

(75) Inventors: Steven T. Patton, Springfield, OH (US); Jeffrey H. Sanders, Vandalia, OH (US); Andrey A. Voevodin, Dayton, OH (US); Mark Pender, Mauldin, SC (US); Richard A. Vaia, Beavercreek, OH (US); Robert I. MacCuspie, Beavercreek, OH (US); Steve J. Diamanti, Xenia, OH (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 232 days.

(21) Appl. No.: 11/998,975

(22) Filed: Oct. 29, 2007

(51) Int. Cl.
*H01H 51/22* (2006.01)

(52) U.S. Cl. ..... 335/78; 200/181

(58) Field of Classification Search ..... 335/78; 200/181

See application file for complete search history.

(56) References Cited

U.S. PATENT DOCUMENTS

| | | | | |
|---|---|---|---|---|
| 3,620,839 | A | 11/1971 | Geckle et al. | |
| 3,758,733 | A | 9/1973 | Durocher et al. | |
| 5,316,507 | A | 5/1994 | Capp | |
| 5,905,000 | A | 5/1999 | Yadav et al. | |
| 6,472,459 | B2 | 10/2002 | Morales et al. | |
| 6,507,989 | B1 | 1/2003 | Bowden et al. | |
| 6,791,338 | B1 | 9/2004 | Bratkovski et al. | |
| 6,838,627 | B1 | 1/2005 | Isberg et al. | |
| 6,998,637 | B2 | 2/2006 | Luyken et al. | |
| 7,008,604 | B2 | 3/2006 | Smalley et al. | |
| 7,270,694 | B2 * | 9/2007 | Li et al. | 75/351 |
| 2005/0150684 | A1 * | 7/2005 | Hashimoto | 174/256 |
| 2007/0080054 | A1 * | 4/2007 | Parkansky et al. | 204/164 |
| 2007/0247401 | A1 * | 10/2007 | Sasagawa et al. | 345/84 |
| 2008/0169464 | A1 * | 7/2008 | Gong et al. | 257/40 |
| 2008/0265414 | A1 * | 10/2008 | Ho et al. | 257/741 |
| 2009/0110812 | A1 * | 4/2009 | Li et al. | 427/125 |

FOREIGN PATENT DOCUMENTS

WO WO 2006/110166 A2 10/2006

OTHER PUBLICATIONS

B. Smarsly et al., "Liquid Inorganic-Organic Nanocomposites: Novel Electrolytes and Ferroflulds", *Angew. Chem. Int. Ed.*, 2005, pp. 3809-3811, vol. 44.

(Continued)

*Primary Examiner*—Elvin G Enad
*Assistant Examiner*—Bernard Rojas
(74) *Attorney, Agent, or Firm*—AFMCLO/JAZ; Gerald B. Hollins; Fredric L. Sinder

(57) ABSTRACT

A life and electrical properties enhanced microelectromechanical systems (MEMS) switch apparatus in which a combined nanoparticle and ionic fluid lubricant is used to prolong switch elements operating lifetime and desirable electrical characteristics during this lifetime. Nanoparticle materials such as noble metal particles are combined with ionic corona producing liquid organic materials to achieve a desirable contact lubricant material serving to delay the onset of several disclosed classic contact failure mechanisms. Improvement over other contact lubricant materials and favorable contact testing results are included.

12 Claims, 13 Drawing Sheets

OTHER PUBLICATIONS

M. Chhowalla et al., "Thin Films of Fullerene-Like $MoS_2$ Nanoparticles with Ultra-Low Friction and Wear", *Nature*, Sep. 14, 2000, pp. 164-167, vol. 407.
L. Rapoport et al., "Hollow Nanoparticles of $WS_2$ as Potential Solid-State Lubricants", *Nature*, Jun. 19, 1997, pp. 791-793, vol. 387.
A.B. Bourlinos et al., "Surface-Functionalized Nanoparticles with Liquid-Like Behavior", *Adv. Mater*., Jan. 31, 2005, pp. 234-237, vol. 17, No. 2.
A.B. Bourlinos et al., "Layered Organosilicate Nanoparticles with Liquidlike Behavior", *Small*, 2005, pp. 80-82, vol. 1, No. 1.
A.B. Bourlinos et al., "Functionalized Nanostructures with Liquid-Like Behavior: Expanding the Gallery of Available Nanostructures", *Adv. Func. Mater*., 2005, pp. 1285-1290, vol. 15.
A.B. Bourlinos et al., "Functionalized ZnO Nanopoarticles with Liquidlike Behavior and their Photoluminescence Properties", *Small*, 2006, pp. 513-516 vol. 2, No. 4.
S.T. Patton et al., "Failure Mechanisms of Capacitive MEMS RF Switch Contacts", *Tribology Letters*, Aug. 2005, pp. 265-272, vol. 19, No. 4.
S.T. Patton et al., "Effects of Dielectric Charging on Fundamental Forces and Reliability in Capacitive Miccroelectromechanical Systems Radio Frequency Switch Contacts", *Journal of Applied Physics*, 2006, pp. 094910-1 to 094910-11, vol. 99.
S.T. Patton et al., "Fundamental Studies of Au Contacts in MEMS RF Switches", *Tribology Letters*, Feb. 2005, pp. 215-230, Volme 18, No. 2.

* cited by examiner

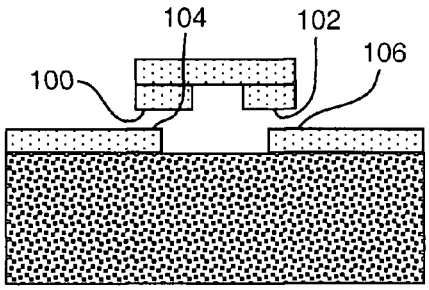
Fig. 1a
Prior Art
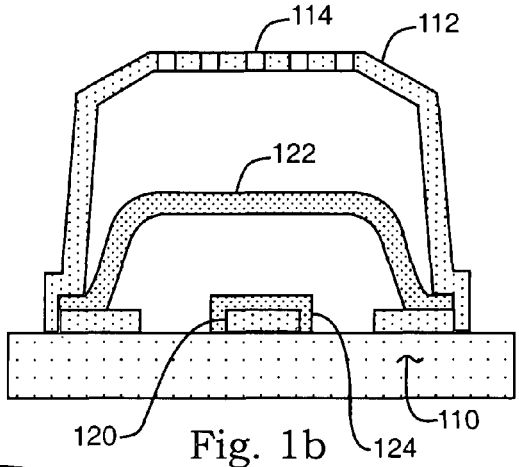
Fig. 1b
Prior Art
Fig. 1
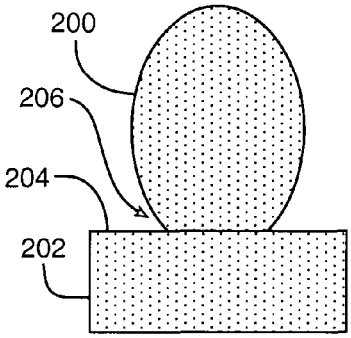
Fig. 2a
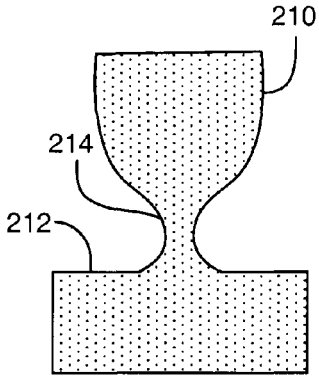
Fig. 2b
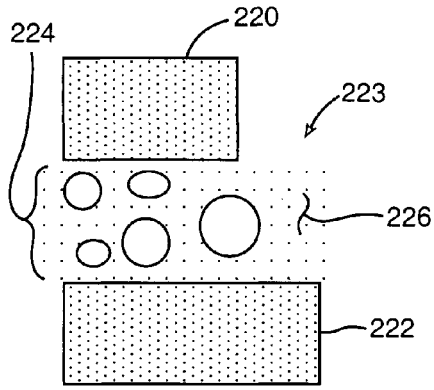
Fig. 2c
Fig. 2

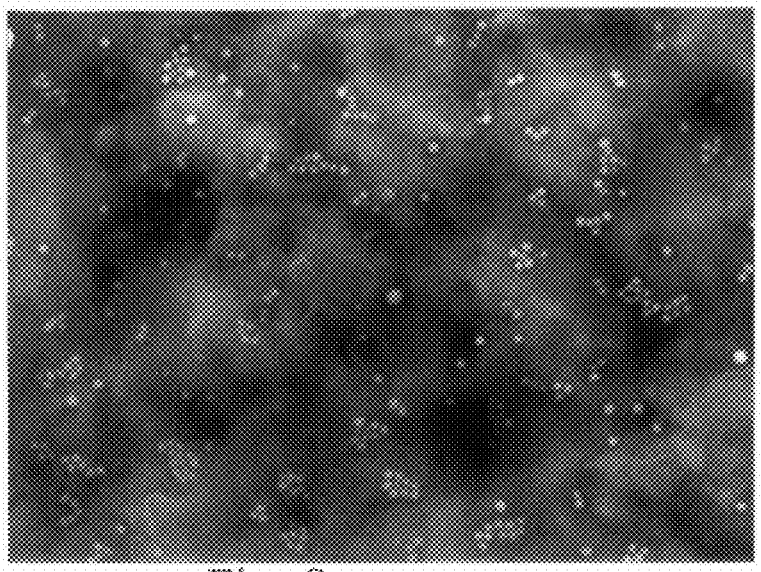
Fig. 8a
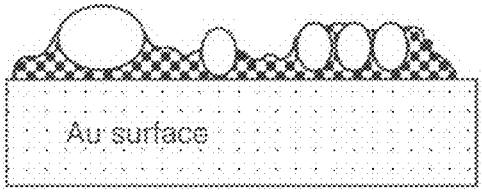
Fig. 8b
Fig. 8
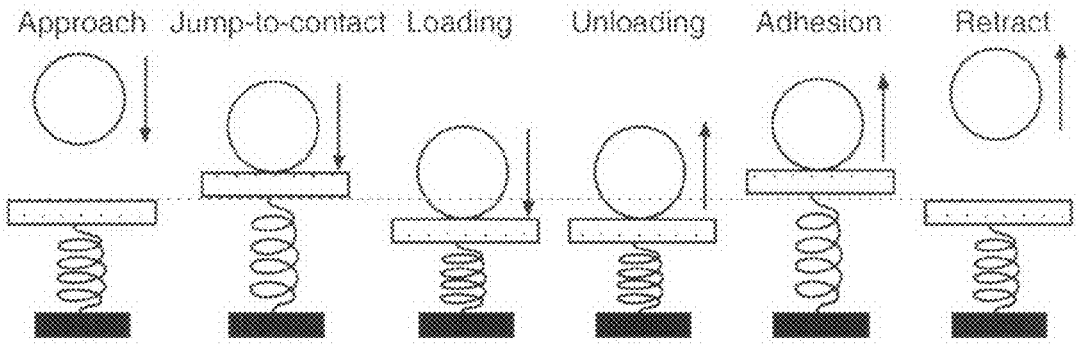
Fig. 9a Fig. 9b Fig. 9c Fig. 9d Fig. 9e Fig. 9f
Fig. 9

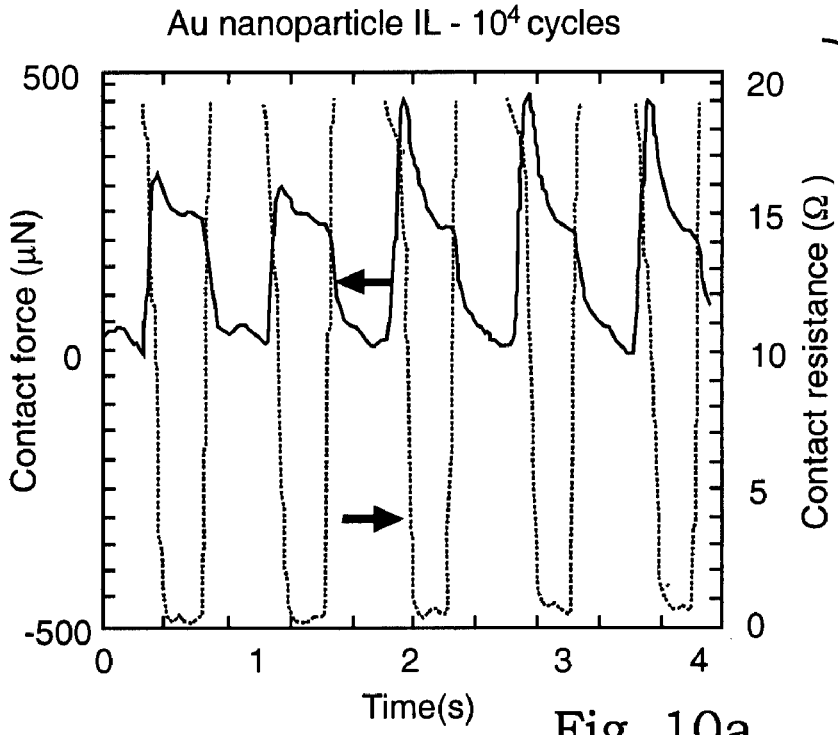
Fig. 10a
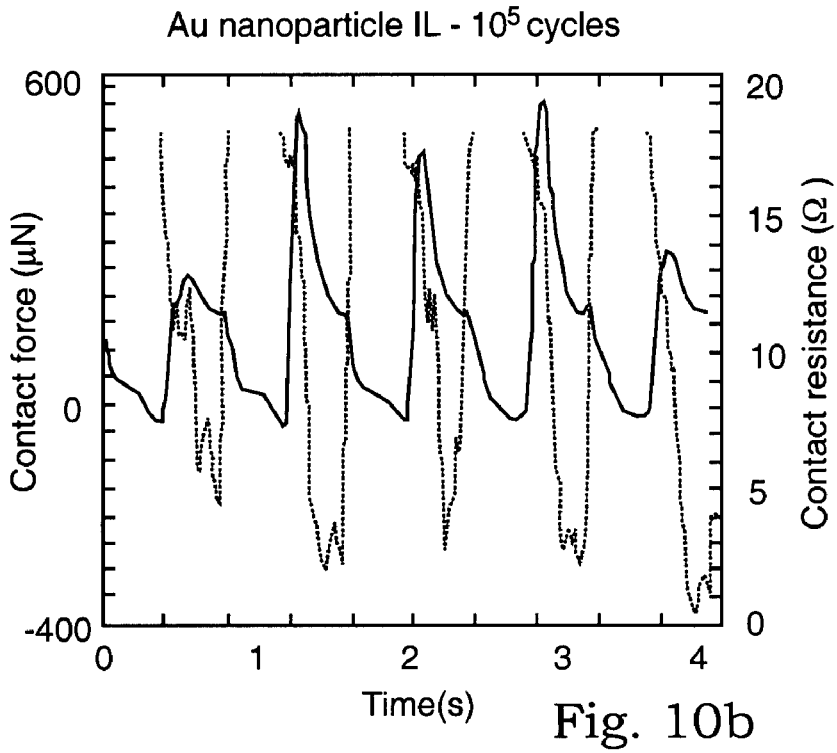
Fig. 10b
Fig. 10

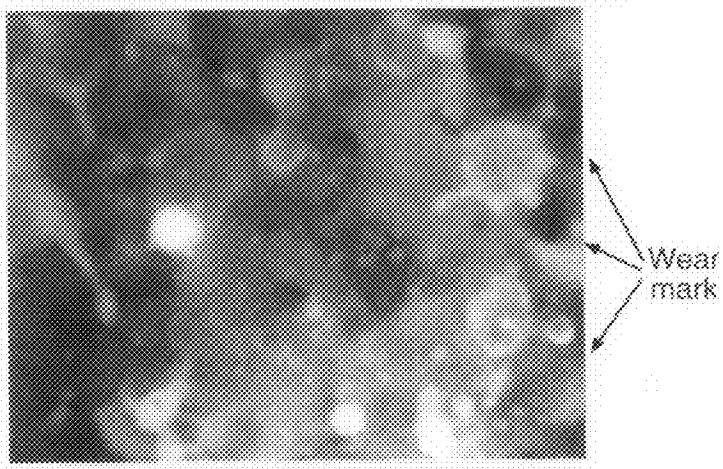
Fig. 12b
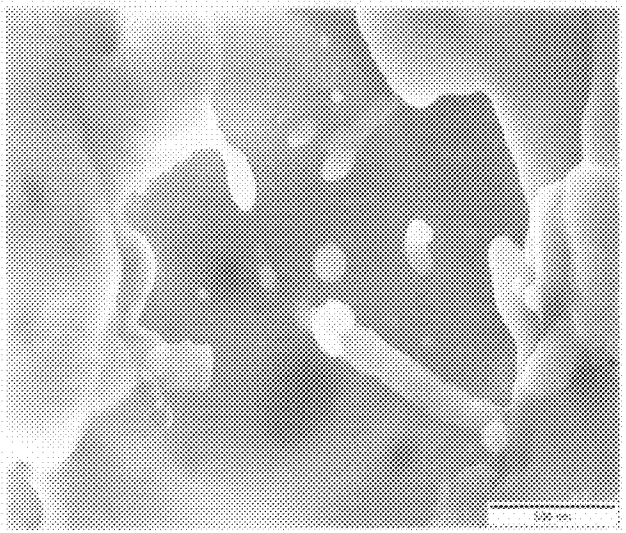
Fig. 12c
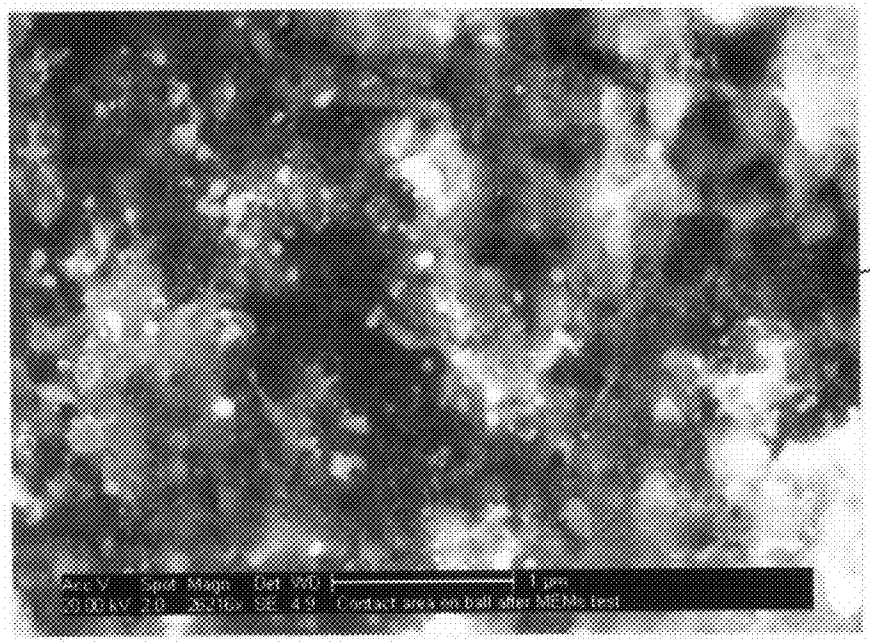
Fig. 12a
- Nanoparticle agglomerates
- Restricted size melting regions
- Termination of nanowire growth
Fig. 12

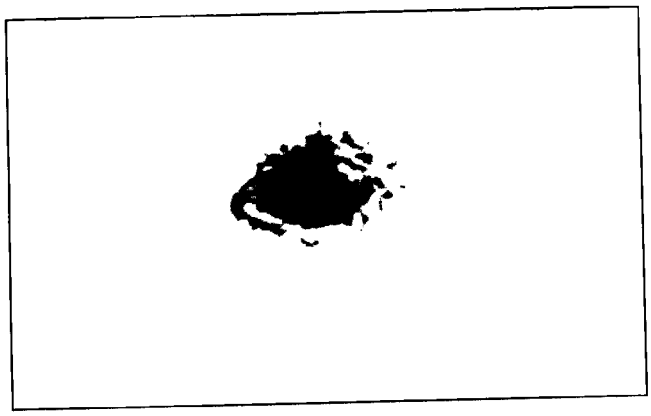
Fig. 13a
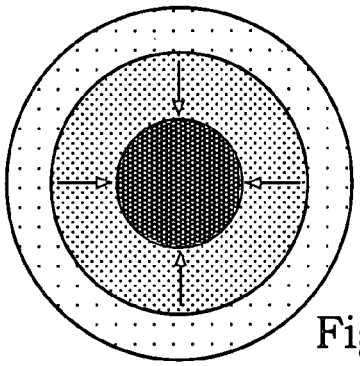
Fig. 13b
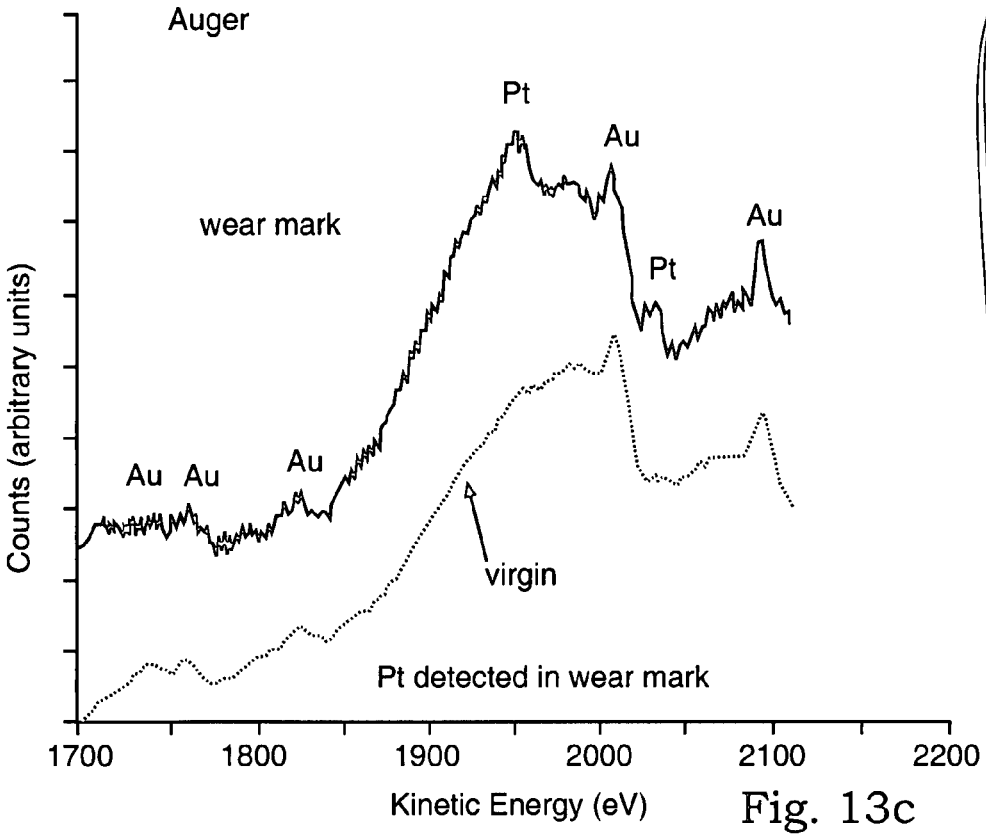
Fig. 13c
Fig. 13

1400
200
150
100
50
0
-50
-100
34.4 µm
1400

1405
1404
1408
1406
1407
1412
1410

1422
1421
1420
1424
5 µm

5 µm
1426
1428
1430
1435
c
1432
Auger line scan
Signal (arbitray units)
Au
1434
1436
1440
1438
0
10
20
30
40
50
60
Distance (µm)

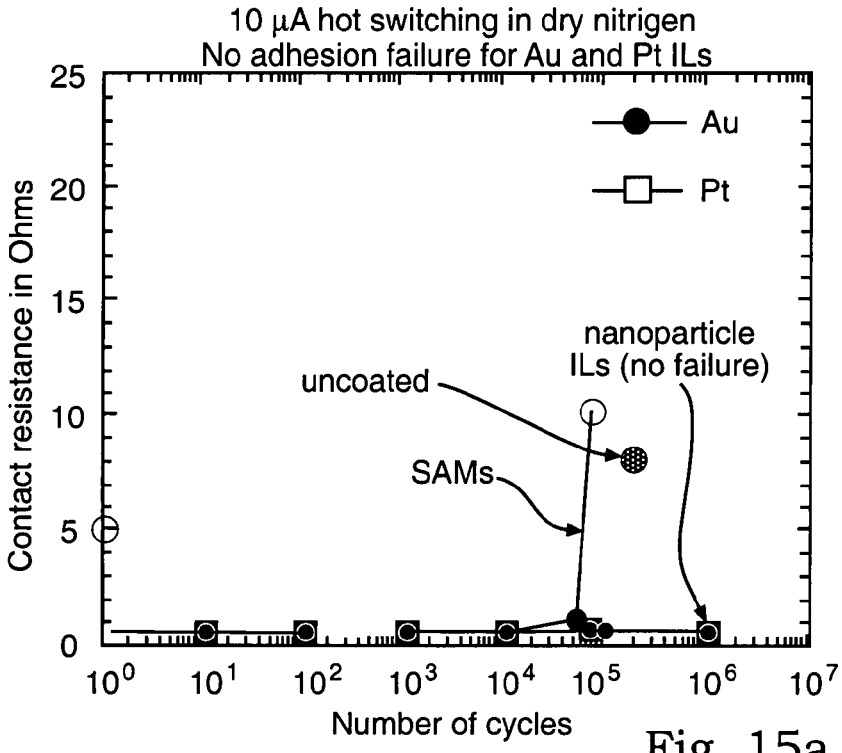
Fig. 15a
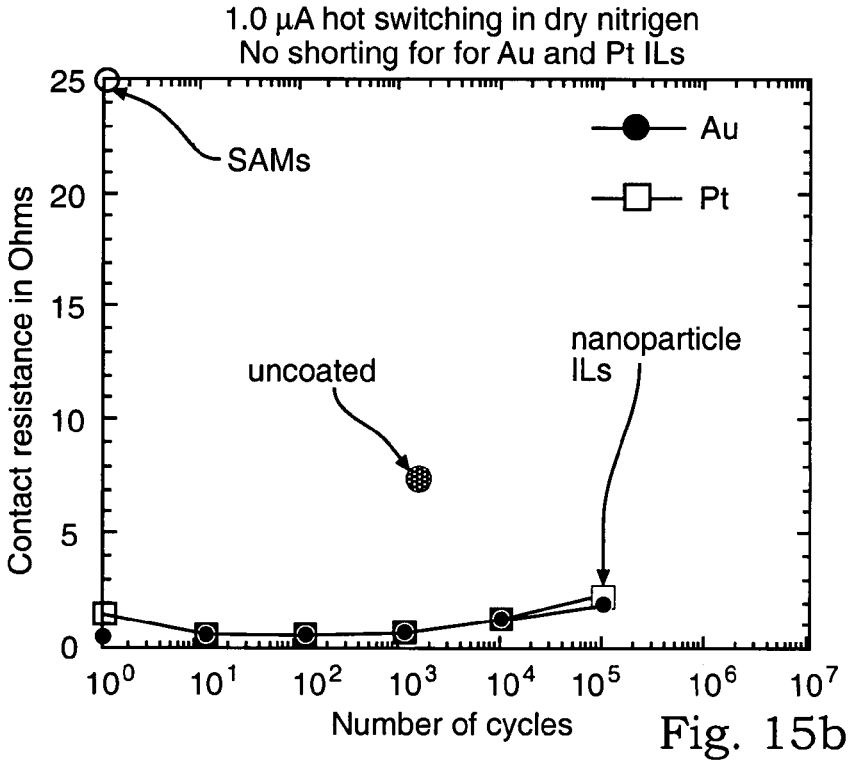
Fig. 15b
Fig. 15

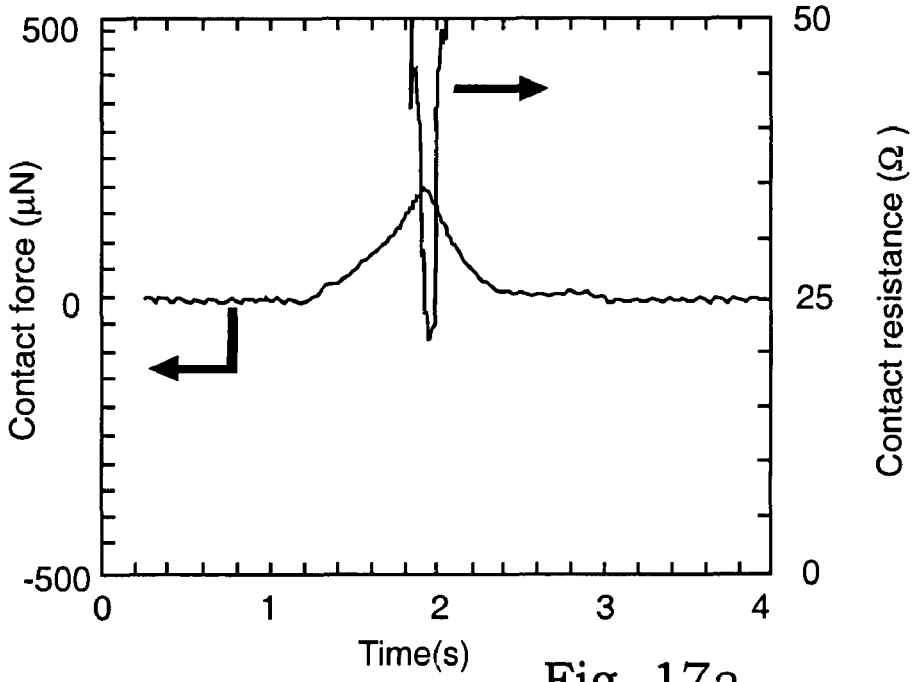
Fig. 17a
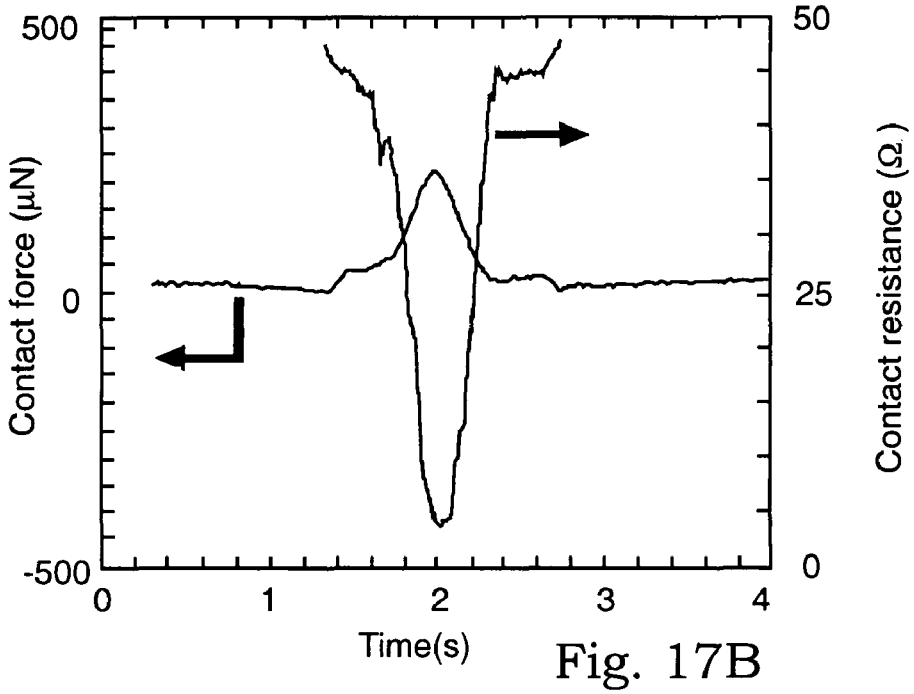
Fig. 17B
Fig. 17

NANOPARTICLES AND CORONA ENHANCED MEMS SWITCH APPARATUS

RIGHTS OF THE GOVERNMENT

The invention described herein may be manufactured and used by or for the Government of the United States for all governmental purposes without the payment of any royalty.

BACKGROUND OF THE INVENTION

The microelectromechanical systems (MEMS) switch has become an essential element in many electronic systems and would find even greater usage in integrated circuit and other electrical applications, except for its fundamentally electromechanical nature and thus excessively limited operating lifetime. The fundamental mechanical limitations of wear, stiction and thermal response as well as electrical resistance, R, increases and other mechanical related properties are clearly present in these small switches to a degree, currently precluding use of such elements except in well defined and probably mostly non-critical switching applications. MEMS lifetimes measured at $10^9$ and upward operating cycle events would clearly increase the use of such switches to a significant degree.

Thus even though the electrical switching art reveals a considerable degree of direct approach attention to the improvement of MEMS switches over the years, there appears to exist in this art a degree of avoidance of one indirect approach to the improvement of many of the MEMS encountered fundamental mechanical limitations. This indirect approach involves the use of lubrication for the switch elements, especially lubrication with materials having more than friction related improvement capabilities, modern materials able to also contribute to a plurality of electrical characteristics of a treated switch.

Previous lubricant based attempts to realize increased lifetimes have included the addition of self-assembled monolayer (SAM) lubricant materials, including materials derived from diphenyl disulfide and other lubricants, to MEMS contacts. Such additions provide less than desired performance often because of carbonaceous film growth and contact resistance difficulties encountered in the range of $10^4$ operating cycles with, for example, 10 microamperes of load current and from heat promoted failures incurred very early in the presence of one milliampere load currents. Improved lubrication involving nanoparticles in combination with plasma is the domain of the present invention.

Nanoparticles in general are considered in the World Intellectual Property Organization (WIPO) published patent application 2006/110166 of E. P. Giannelis et al. of Cornell University. This application designates the United States as one of several locations in which patent protection is sought. The application is titled "Functionalized Nanostructures with Liquid-Like Behavior" and is hereby incorporated by reference herein. The work leading to this application was also supported by the U.S. Air Force.

SUMMARY OF THE INVENTION

The present invention provides improved life and operating characteristics for an electrical switch, especially a switch of the microelectromechanical systems or MEMS type.

It is therefore an object of the present invention to provide nanoparticle based lubrication and electrical characteristics enhancements in plural types of MEMS related electrical switch elements.

It is another object of the present invention to provide metallic and ionic nonmetallic lubricant nanoparticles based electrical switch characteristic enhancements.

It is another object of the present invention to provide a plurality of MEMS switch nanoparticle based lubrication and contact enhancement materials.

It is another object of the present invention to provide increased operating life in a MEMS electrical switch apparatus.

It is another object of the invention to employ the combination of ionic liquid materials and metallic nanoparticle materials as a lubricant in a MEMS electrical switch.

It is another object of the present invention to achieve decreased electrical resistance characteristics over the useful life of a metal contact MEMS electrical switch.

It is another object of the present invention to limit the effects of plural failure mechanisms in a MEMS electrical switch.

It is another object of the present invention to provide a selectable viscosity lubricant material in a MEMS electrical switch.

It is another object of the present invention to provide control of use induced contact surface bonding in a MEMS electrical switch.

It is another object of the present invention to provide enhanced surface conformity in a MEMS electrical switch.

It is another object of the present invention to provide controlled volatility in a MEMS electrical switch lubricant.

It is another object of the present invention to provide enhanced thermal stability in the operation of a MEMS electrical switch.

It is another object of the present invention to provide enhanced current, i.e., conduction characteristics in a MEMS electrical switch.

It is another object of the present invention to reduce use-provoked friction, stiction, wear and conductivity degradations in a MEMS electrical switch apparatus.

These and other objects of the invention will become apparent as the description of the representative invention embodiments proceeds.

These and other objects of the invention are achieved by a microelectromechanical systems (MEMS) electrical switch comprising:

first and second selectively engageable-nano sized MEMS switch electrical contacts; and an electrically conductive lubricant film material received intermediate engaging face portions of said nano-sized MEMS switch electrical contacts;

said lubricant film material including a plurality of metallic nanoparticles resident on a face portion of one of said nano-sized MEMS switch electrical contacts;

said lubricant film material also having an ionized particle inclusive liquid surrounding said metallic nanoparticles on said face portion of said nano-sized MEMS switch electrical contacts and supplementing inter contact electrical conductivity characteristics and nanoparticle migration characteristics of said metallic nanoparticles.

BRIEF DESCRIPTION OF THE DRAWINGS

The accompanying drawings incorporated in and forming a part of the specification, illustrate several aspects of the present invention and together with the description serve to explain the principles of the invention. In the drawings:

FIG. 1 includes the views of FIG. 1*a* and FIG. 1*b* and shows cross-sectional representations of two different types of microelectromechanical systems switches.

FIG. 2 includes the views of FIG. 2*a*, FIG. 2*b* and FIG. 2*c*, and shows two common failure mechanisms incurred in MEMS switches and a present invention resolution thereof.

FIG. 8 includes the views of FIG. 8*a* and FIG. 8*b* and shows enlarged representations of a spin coated nanoparticle lubricant MEMS switch contact.

FIG. 9 includes the views of FIG. 9*a*, FIG. 9*b*, FIG. 9*c*, FIG. 9*d*, FIG. 9*e* and FIG. 9*f*, and shows details of a MEMS contact related laboratory evaluation arrangement.

FIG. 10 includes the views of FIG. 10*a* and FIG. 10*b*, and shows representative initial and degraded MEMS switch contact characteristics.

FIG. 12 includes the views of FIG. 12*a*, FIG. 12*b* and FIG. 12*c*, and shows additional magnifications of an enlarged portion of the FIG. 11 lubricated contact wear scar with a non-lubricated comparison scar.

FIG. 13 includes the views of FIG. 13*a*, FIG. 13*b* and FIG. 13*c*, and shows contact wear scar physical details and wear scar chemical analysis.

FIG. 15 includes the views of FIG. 15*a* and FIG. 15*b*, and shows electrical performance details of a nanoparticle lubricated MEMS contact.

FIG. 17 includes the views of FIG. 17*a* and FIG. 17*b*, and shows a comparison of present invention and prior SAMS lubricant testing results.

DETAILED DESCRIPTION OF THE INVENTION

Figure 3:
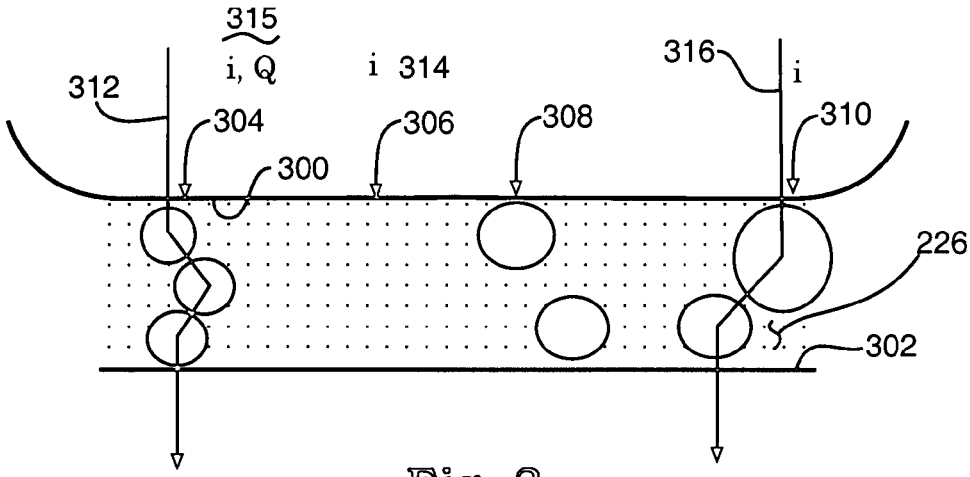
FIG. 3 shows an enlarged view of adjacent MEMS switch contacts including an intervening nanoparticle lubricant material.

FIG. 1 in the drawings includes the views of FIG. 1*a* and FIG. 1*b*, and shows cross-sectional representations of two different types of microelectromechanical systems (MEMS) switches. In the FIG. 1*a* drawing there appears a cross-sectional representation of a metal to metal variety MEMS contact set in which, upon deflection of a contact suspension apparatus (not shown), the faces 100 and 102 of an upper movable contact pair meet with corresponding lower contact faces 104 and 106. This meeting can of course be accompanied by electrical spark erosion, contact buffing, contact wear and other contact life limiting mechanisms. The present invention provides assistance in achieving delayed onset of several of these limiting mechanisms.

FIG. 1*b* in the drawings shows details of another form of MEMS electrical switch, an enclosed switch in which capacitance coupling is used to achieve signal transfer between switch input and output electrical circuits. Notwithstanding the absence of specific metal to metal engagement in the FIG. 1*b* switch arrangement, such switches and their "contacts" are nevertheless subject to some of the same and to additional failure mechanisms as in the FIG. 1*a* metal to metal switch arrangement. Details of these capacitance coupled switch failure mechanisms may be appreciated in ensuing paragraphs herein.

In the FIG. 1*b* drawing there is shown, for example, a substrate 110 on which is received a switch enclosure 112 having a plurality of enclosure openings 114 usable during certain switch fabrication steps. The FIG. 1*b* MEMS switch includes a substrate 110-held fixed position contact 120, a movable contact 122 and an electrical insulating member 124 holding the contacts 120 and 122 in a non-touching but increased capacitance coupling physical condition when the movable contact 122 is changed from the FIG. 1*b* illustrated "open" switch condition to a closer, contact "closed", switch condition wherein increased capacitance coupling and signal transmission between contacts 120 and 122 occur. Distorted movement of the contact 122 and its engagement with the insulating member 114 of course contributes to some of the previously identified and other life limiting switch degradation mechanisms. Such mechanisms may include, for example, frictional and impact wearing of the insulating member 114.

FIG. 2 in the drawings includes the views of FIG. 2*a*, FIG. 2*b* and FIG. 2*c*, and illustrates two especially significant of the common failure mechanisms incurred in MEMS switches and also represents generally a present invention approach toward alleviation of these failure mechanisms. In the FIG. 2 drawings a movable MEMS contact 200 is shown to be engaged with a smooth surface 204 of a fixed position contact 202 at an interface 206, while in the condition of the contacts 200 and 202 being held in low electrical current provoked contact adhesion. In the FIG. 2*b* drawing a movable MEMS contact 210 is shown coupled to a fixed position contact 212 by an extended nanowire connection represented at 214. This nanowire connection represents a commonly encountered degradation or failure mechanism in a MEMS switch circuit and is also found to be subject to present invention intervention. Low electrical current provoked flat contact adhesion as in the FIG. 2*b* drawing is relieved by the nanoparticle and ionized liquid fluid of the present invention remaining with the contact faces during contact open and closed events, thus precluding a flat surface adhesion.

A general representation of the present invention arrangement for alleviating the degraded MEMS switch conditions represented in the FIG. 2*a* and FIG. 2*b* drawings is shown in the FIG. 2*c* drawing. In this drawing the two contacts 220 and 222 are shown to be separated by an array of metallic nanoparticles 224 surrounded by a liquid 226 containing ionized nonmetallic organic material particles. Together the nanoparticles 224 and the liquid 226 comprise a present invention contact "lubricant" 223 affording a plurality of MEMS contact advantages as are described in detail in following paragraphs herein.

The FIG. 2*c* lubricant 223 can be described as a monolithic hybrid nanoparticle material comprised of an inorganic nanosized metallic core and an organic low viscosity corona. Advantages of such nanoparticle lubricants as compared to ordinary nanoparticles include (1) less agglomeration; (2) better processing; (3) controlled particle interactions; and (4) production of a solvent-free liquid. An ionic liquid may be used as a corona offering advantages such as (1) high fluidity; (2) low melting temperature; (3) high boiling temperature; (4) thermal stability; and (5) low vapor pressure. As a contact lubricant these materials appear to provide high conductivity of metallic nanoparticles and enablement for lubricant reflow to damaged areas.

FIG. 3 in the drawings shows an enlarged view of a closed MEMS switch including nanoparticle agglomerations 304, 306, 308 and 310 disposed between two switch contact surfaces 300 and 302. In this closed condition the particle agglomerations 304 and 310 complete an electrical path 312 and 316 between contact surfaces 300 and 302 to allow electrical current, i, and electrical charge, Q, as indicated at 315, to flow across the opening between contact surfaces. Additional parallel current paths exist by way of each additional touching particles (not shown) in the region between contacts. The agglomeration of particles at 308 is considered to be non-touching and to comprise an open circuit electrical path. The metal particle sizes in the FIG. 3 agglomerations may, for example, range between five and twenty nanometers and the separation of contact surfaces 300 and 302 reside in this same dimensional range.

Figure 4:
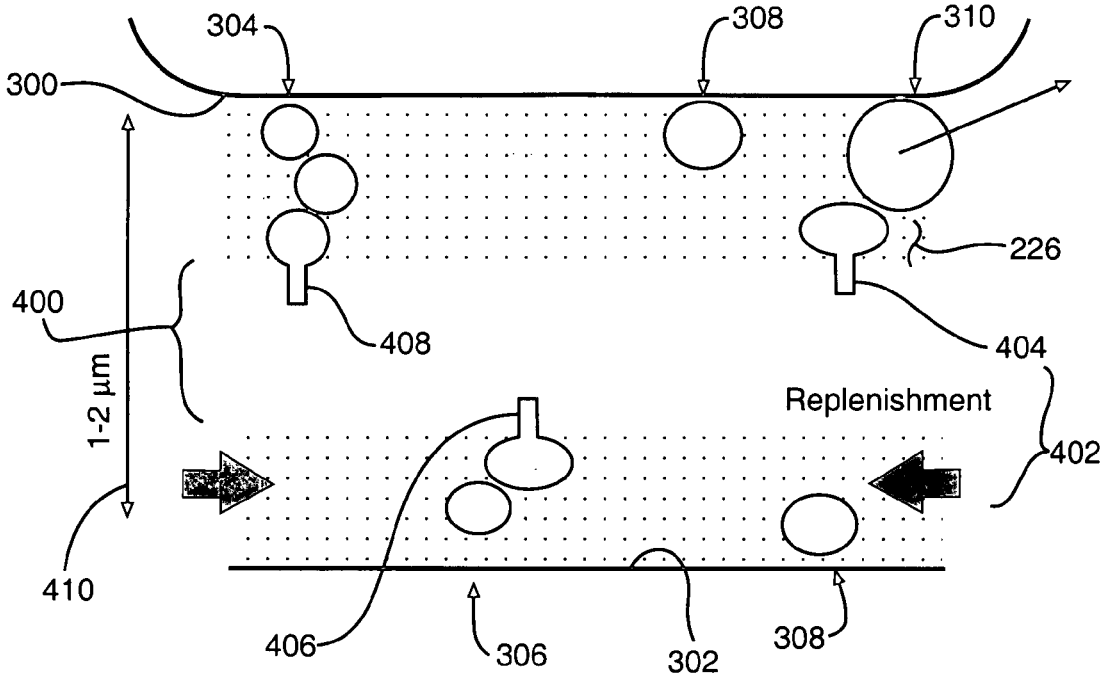
FIG. 4 shows an enlarged view of open MEMS switch contacts including nanoparticle lubricant material.

FIG. 4 in the drawings shows a view of the FIG. 3 closed MEMS switch in an open switch condition and with a spacing of one to two micrometers present between switch contact surfaces 300 and 302. In this open switch condition multiple desirable aspects of the present invention nanoparticle fluid become visible, as are indicated at 402 and 404, for examples. Shortened terminations of what are often switch shorting nanowires formed during the electrical arcing of opening switch contacts are represented at 404, 406 and 408 in FIG. 4. Early termination of such shorting is a first of the desirable aspects of the combined metal nanoparticle and organic particle fluid present at 226 in the FIG. 2, FIG. 3 and FIG. 4 drawings. This shortening of nanowires is found to improve the tendency of a MEMS switch opening event to result in an electrically shorted contact pair.

The nanoparticle fluid replacement mechanism identified at 402 in FIG. 4 is another of the desirable aspects of the combined metal nanoparticle and organic particle fluid present at 304, 306, 308, and 310 and at 226 in the FIG. 2, FIG. 3 and FIG. 4 drawings. Since the nanoparticle fluid film exists in a liquid or near-liquid state between closed switch contacts as shown in FIG. 3, any evaporation or consumption of this fluid as a result of the contact opening is at least partially accommodated by a fluid replacement mechanism. The drawings of FIG. 13 and FIG. 14 and related discussions herein provide additional details concerning the achieved nanoparticle fluid migration mechanism.

Figure 5:
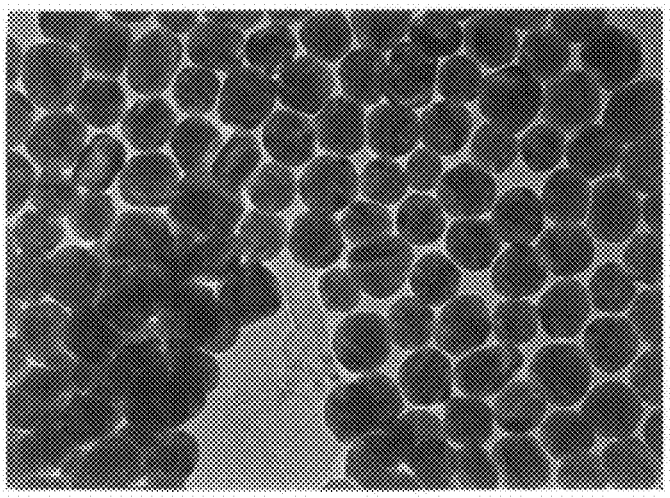
FIG. 5 shows a microphotograph view of nanoparticle liquid material.

FIG. 5 in the drawings shows a transmission electron microscope (TEM) microphotograph image obtained by passing an electron beam through a sample of nanoparticle liquid into a fluorescent screen. The individual metal particles appearing in FIG. 5 are of Gold and of about 20 to 30 nanometers diameter and are immersed in an ionic liquid filling the spaces between metallic particles. Platinum particles of smaller 5 nanometers diameter provide a similar result from TEM exposure and lubrication properties of desirable advantage in selected uses. From an overall viewpoint particle sizes between about one and one hundred nanometers are of interest for use in the present invention; specific instances herein however, identify particles falling in a smaller part of this overall range.

Figure 6:
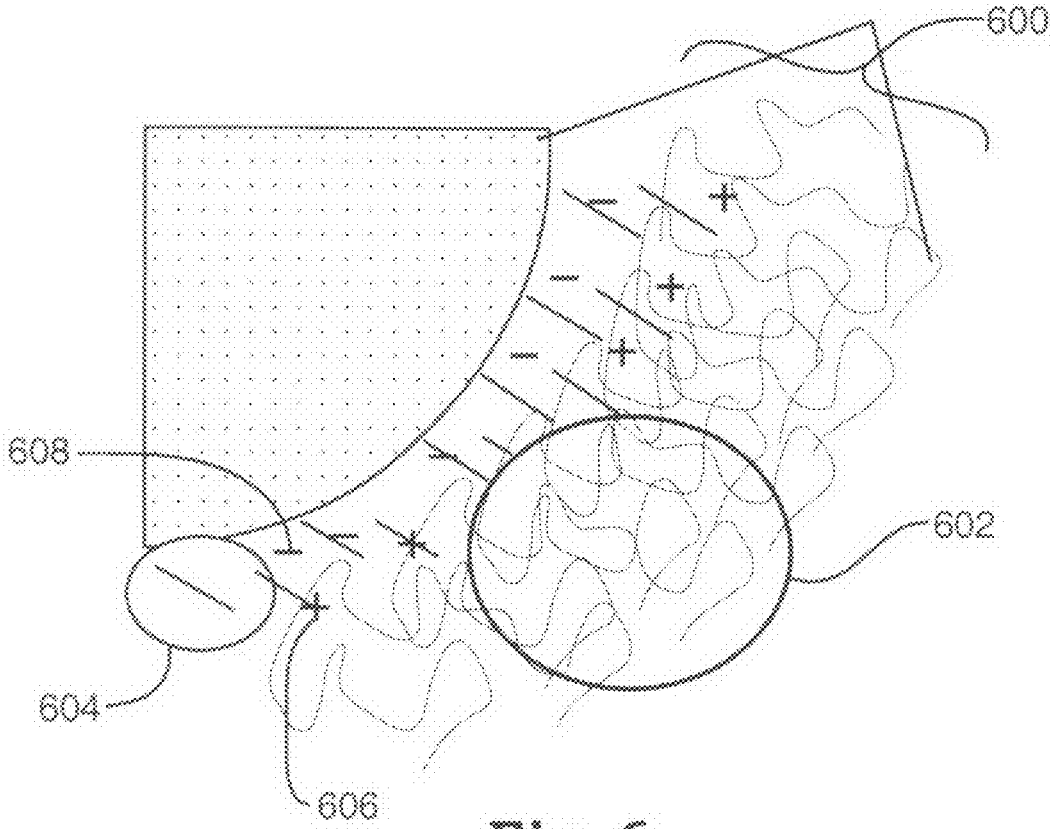
FIG. 6 shows a diagrammatic representation of a metallic nanoparticle in combination with an ionized organic material.
Figure 7:
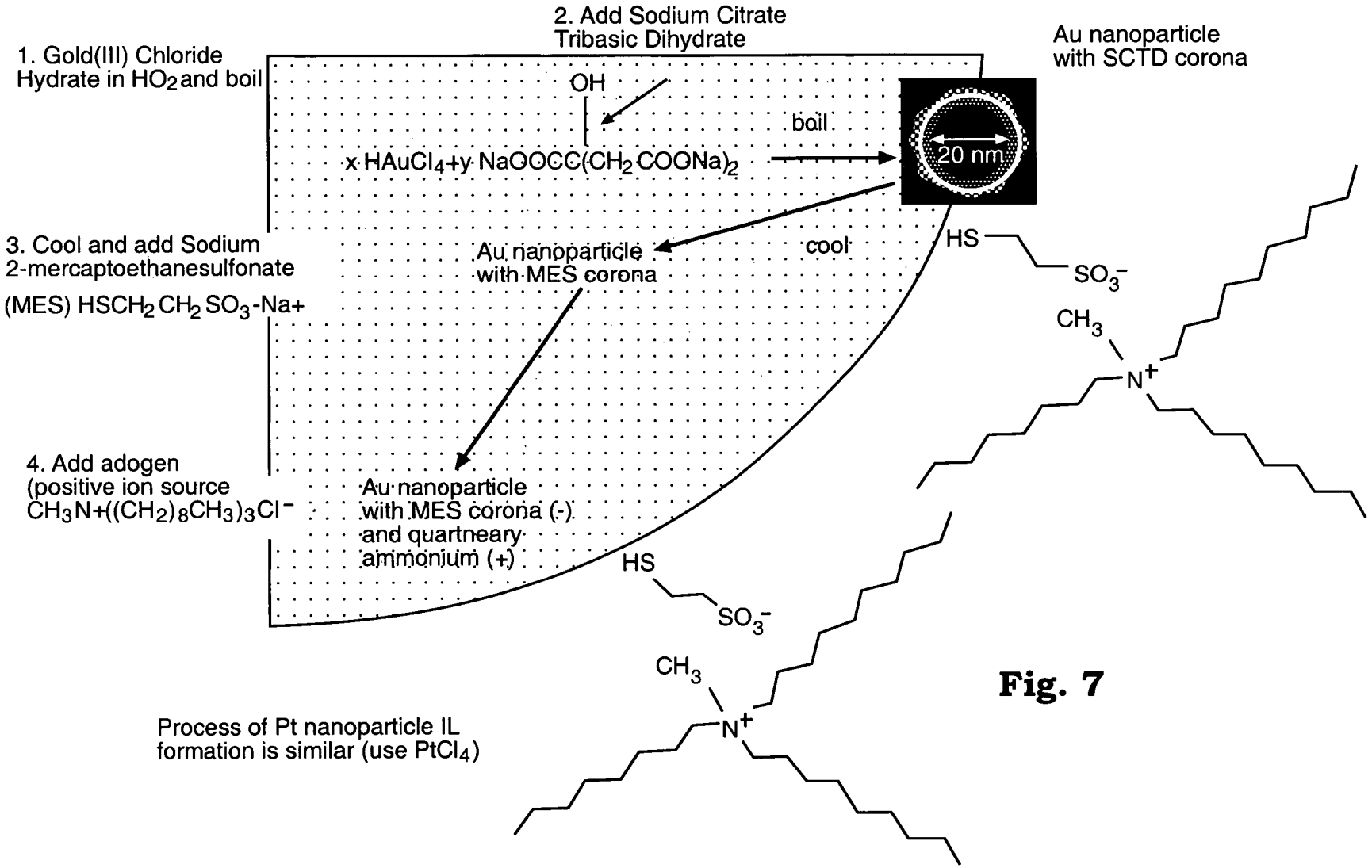
FIG. 7 shows a synthesis sequence for one embodiment of present invention MEMS lubricant materials.

FIG. 6 in the drawings shows a representation of an individual FIG. 5 nanoparticle of, for example, Gold metal together with one arrangement of a corona of organic ionic particle fluid attending this nanoparticle. In the FIG. 6 drawing the ionic particle corona at 600 may be of about 1.5 to 2 nanometers in thickness and may be comprised at 604 of mercaptoethanesulfonate, $HSCH_2CH_2SO_3$, and at 602 of quartneary ammonium materials, $(CH_3)N+R_3$ where $R=C_{10}-C_{12}$. Other corona materials are believed feasible. Charge polarity indicators relevant to the ionized materials at 602 and 604 appear at 606 and 608 in the FIG. 6 drawing and indicate an attractive force between the ionic fluid and the metallic particle. This attractive force may be described as involving a negative surface charge on the nanoparticle with strong covalent bond coupling between nanoparticle and first layer corona molecules and ionic coupling of lesser strength between first layer corona molecule and second layer corona molecule. In the lubricant art quaternary ammonium is desirable at least partially because of the FIG. 6 and FIG. 7 illustrated long hydrocarbon chain and branch structure that promotes liquidity. The FIG. 6 illustrated combination of metallic nanoparticles with an ionized organic plasma liquid for contact lubrication is believed novel, particularly in the MEMS art.

FIG. 7 in the drawings shows the salient steps in a process for synthesizing the ionic fluid portion of a gold and ionic liquid nanoparticle fluid lubricant invention embodiment. As shown in the FIG. 7 drawing this process may include the following four major steps; other processes are of course possible:

1. Hydrate and boil Gold (III) chloride in water.
2. Add the tribasic dihydrate Sodium Citrate, $xHAuCl_{4+yNaOOCC(CH_2COONa)_2}$ (with an OH radical attaching vertically to the final C of the yNaOOCC), then boil to achieve 20 nanometers diameter Gold particles.
3. Cool and add Sodium 2-mercaptoethanesulfonate, (MES) $HSCH_2CH_2SO_3-Na+$, to achieve Gold SCTD nanoparticle with MES corona.
4. Add adogen (quaternary ammonium) positive ion source to achieve $CH_3N+((CH_2)_8CH_3)_3Cl-$, a Gold nanoparticle with negatively charged MES and positively charged quaternary ammonium corona.

The relative inside and outside directions of the ionic charges shown in the FIG. 7 drawing with respect to the metallic nanoparticle are notable in the present invention. A FIG. 7-*like* process may also be used with a $PtCl_4$ (Platinum chloride) initial material to achieve a Platinum nanoparticle ionic liquid lubricant. Other metals including Silver, Palladium, Rhodium and Ruthenium are believed usable in the invention lubricant.

To reiterate the FIG. 7 process in alternate and more detailed language, Gold nanoparticles with a 20 nanometers diameter may be synthesized following the known in the art Turkevich method and passivated with a five fold excess of the Sodium salt of mercaptoethanesulfonate (MES). The subsequent ruby-colored aqueous solution may be combined with a 2-fold equivalence of a quaternary alkyl ammonium chloride (Adogen 464). The Gold nanoparticles may be collected and purified from the resultant two-phase, blue-colored mixture by repetitive (5-times) centrifugation and re-suspension in water and ethanol. The product is insoluble in water but forms a ruby-colored solution in toluene as anticipated for dissolution of individual gold nanoparticles of this size. Total gold content varies from 10 to 80 weight percent, depending on the extent of purification in where the excess mass is attributed to the Adogen surfactant.

Small angle neutron scattering and transmission electron microscopy indicate the FIG. 6 organic ionic corona is about 1.5-2 nanometers in thickness. In a similar fashion, Platinum nanoparticles may be produced via the reduction of $H_2PtCl_6$ in the presence of a threefold equivalence of mercaptoethanesulfonate with the dropwise addition of a chilled solution of $NaBH_4$ (170 mm). The ligand exchange step for Adogen may be performed identically as in the case of Gold to yield platinum nanoparticles of about 5-10 nanometers diameter. Nanoparticles may be applied to a gold-plated GaAs wafer surface by spin coating from a toluene solution. Generally a spin coating thickness between 0.5 and 100 nanometers is preferred.

FIG. 8*a* in the drawings shows a microphotograph of a Gold electrode spin-coated with a Gold nanoparticle lubricant. Notably, there is no stacking up of nanoparticles on the surface in FIG. 8*a* as a result of a strong interaction between surface and nanoparticles. Individual nanoparticle and nanoparticle aggregates provide asperity structures with larger lateral dimensions than individual nanoparticles in FIG. 16*a*. Peak-to-valley roughness is about 100 nanometers for the Gold wafers used in this microphotograph with a lateral distance between local peaks of about fifty micrometers.

Figure 16:
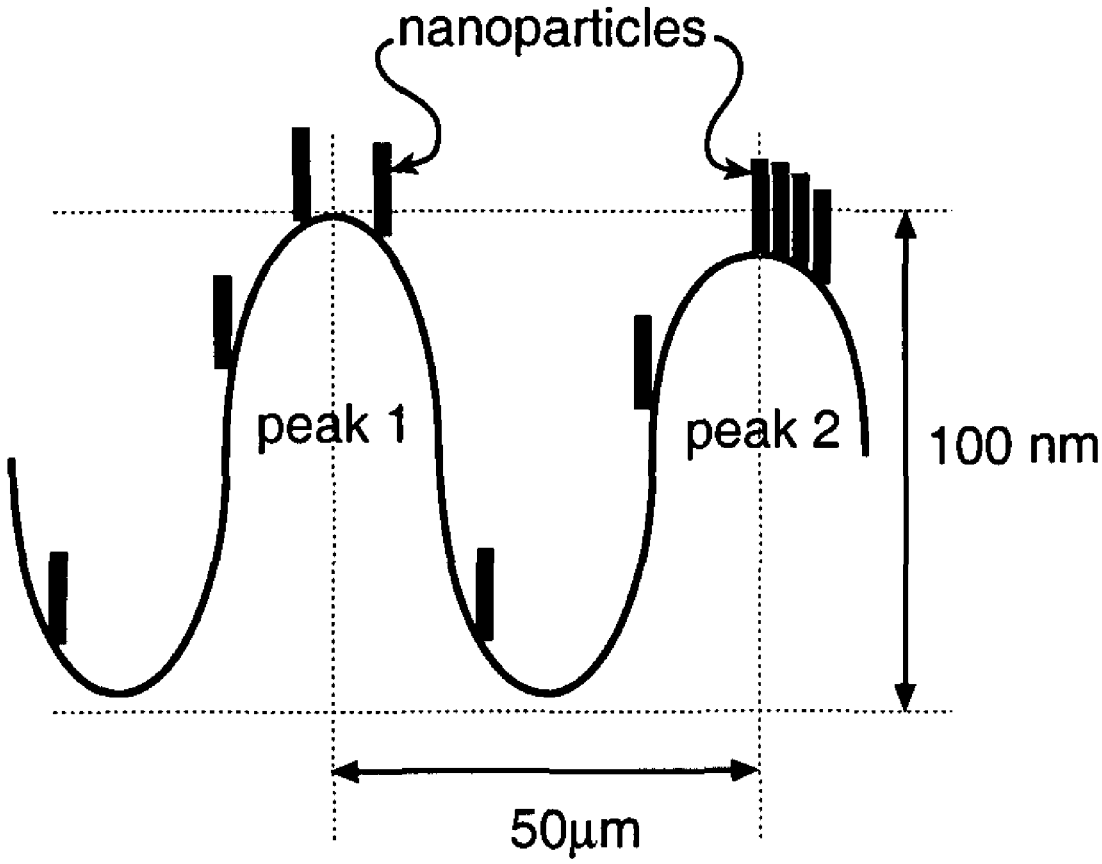
FIG. 16 shows an expanded elevation representation of a nanoparticle lubricant added surface.

A simplified one-dimensional schematic line scan of such nanoparticles is shown in the FIG. 16 drawing. In FIG. 16 the nanoparticles are represented as segments as a result of different scales in the lateral and vertical directions. For illustration purposes, let us assume that the FIG. 16 profile comes into contact with a flat surface; without nanoparticle presence peak 1 comes into contact with the surface and considerable deformation of the profile or contact is needed before peak 2 comes into contact. This leads to large localized contact areas and an undesirable contact situation. With nanoparticle presence, however, two distinct nanocontacts are established on peak 1 and subsequent nanocontacts occur on peak 2. In this way, multiple localized nanocontacts spread out on a surface as opposed to lesser number of larger contact spots.

FIG. 8 in the drawings also shows the appearance of a Gold MEMS electrical contact coated with a film of Gold nanoparticle ionic lubricant. The FIG. 8 drawings include a microphotograph as the FIG. 8*a* "drawing" as do several ensuing "drawings" herein; identifications as "drawing" and "microphotograph" are used interchangeably in ensuing paragraphs herein. The clustered, small, generally round, objects in the FIG. 8*a* microphotograph are of course metallic nanoparticles in the lubricant film. The FIG. 8*a* coating is of about 3.5 nanometers thickness, appears free of particle stacking and is generally of the profile appearing in the FIG. 8*b* microphotograph. Lateral dimensions are indicated in the microphotograph. Multiple sized surface asperities in the lateral and vertical directions appear on the FIG. 8*a* contact surface; as are also shown in FIG. 8*b*.

FIG. 9 in the drawings shows details of MEMS electrical contact laboratory ball-on-wafer experimental arrangement usable to evaluate lubricated MEMS performance. The controlled conditions disclosed in FIG. 9 and the resulting subsequent FIG. 10 test results drawings herein are believed to provide consistent indications of switch life and lubricant behavior under meaningful conditions.

FIG. 10 in the drawings includes the views of FIG. 10*a* and FIG. 10*b*, and shows quantitatively representative initial and degraded MEMS switch contact electrical characteristics achieved with two ensuing contact use test conditions. In these drawings the left hand scale and the left hand scale-connected data curves indicate the applied contact force measured in micro Newtons and the right hand scale and right hand scale-connected data curves indicate the achieved contact resistance measured in Ohms. The time dependent periodic waveforms observed in FIGS. 10*a* and 10*b* result from the pulsating nature of the electrical energy applied to the contact for testing described in the FIG. 9 drawing. Generally it may be observed that achievement of low and unvarying contact resistance is desirable in a pair of tested contacts; time dependent higher resistance is an undesirable characteristic and a contact failure indication. Incurred contact cycles at current loading of one milliampere, i.e. $10^4$ and $10^5$ cycles, are identified in the FIG. 10 drawings.

FIG. 17 in the drawings shows yet another comparison of present invention and prior lubricant assisted contact testing for Gold contacts. The FIG. 17 data in FIGS. 17*a* and 17*b* represents contact force and resistance measurements conducted using a constant approach and a retract speed of 320 nanometers per second and a peak contact force of 200 micro Newtons in a ball laboratory apparatus. Switching performance for the diphenyl disulfide self-assembled monolayer lubricant represented in the FIG. 17*a* drawing leaves much to be desired in view of an immediate failure, with a developed resistance of about 20 ohms as a result of a first contact engagement using the current flow of 1 milliampere. The similar contact and conditions with present invention nanoparticle lubricant included are represented in the FIG. 17*b* drawing, and show desirable improvement in contact life at $10^5$ cycles and one ohm of developed resistance.

Figure 11:
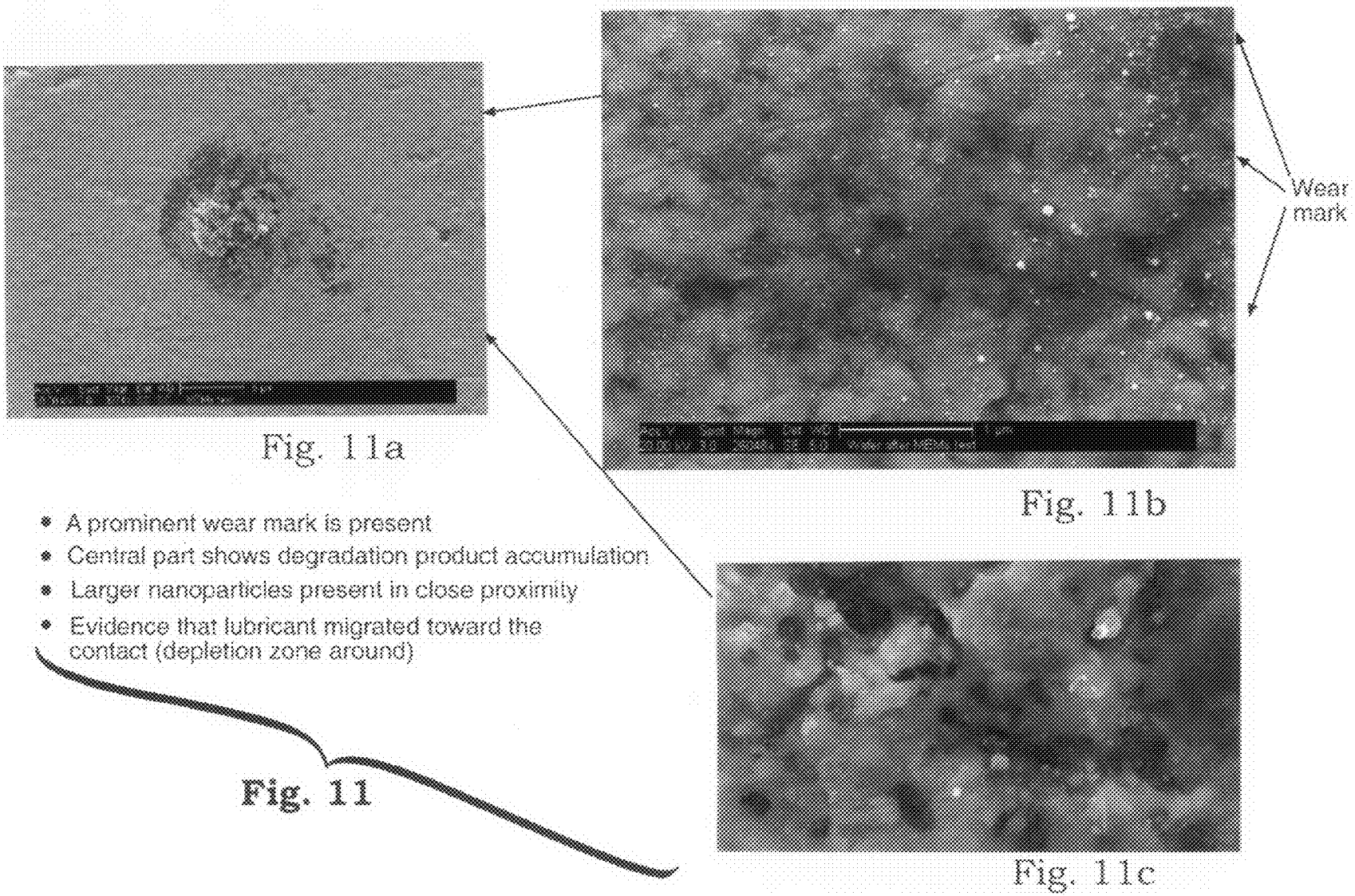
FIG. 11 includes the views of FIG. 11*a*, FIG. 11*b* and FIG. 11*c*, and shows microphotographic representations of a lubricated contact wear scar.

FIG. 11 in the drawings includes the microphotograph views of FIG. 11*a*, FIG. 11*b* and FIG. 11*c*, and shows a physical wear scar resulting from extended FIG. 9 indicated testing of a Gold nanoparticle lubricated Gold MEMS contact. FIG. 11*a* shows a coated wafer wear scar achieved after $10^5$ cycles of 1 millampere contact opening and closing using a particular magnification as may be appreciated from the electron microscope parameters shown in the lower margin of the drawing or microphotograph. The FIG. 11*b* and FIG. 11*c* views of the same wear scar represent greater magnifications as may be observed from the dimensional indications appearing in each drawing view. Of particular interest in the FIG. 11 microphotographs is the fact that $10^5$ current flowing opening and closing events result in an easily visible wear pattern scar; that larger nanoparticles are displaced just outside the FIG. 11*a* wear scar during the opening and closing cycles and that evidence of desirable nanoparticle presence and nanowire termination in the contact appears.

FIG. 12 includes the views of FIG. 12*a*, FIG. 12*b* and FIG. 12*c*, and in the first two views therein shows additional microphotograph magnifications of an enlarged portion of the FIG. 11 lubricated contact wear scar. Thus these parts of FIG. 12 represent another set of views of a $10^5$ cycles nanoparticle film lubricated contact of the FIG. 11 type at the same and greater lubricant film wear area magnifications. Again, the FIG. 12 degree of magnifications is indicated by a scale representation in a portion of the each microphotograph. Of particular interest in FIG. 12 is the nanoparticle agglomerations attending the scar, the limited size of the ball wear area in the FIG. 12*b* microphotograph, together with the limited occurrence and size of undesired contact cycle formed nanowires of the FIG. 2 and FIG. 4 types. The FIG. 12*c* drawing shows the more pronounced tendency to form the nanowire contact shorting structures in a non-lubricated or uncoated MEMS contact as is shown for comparison purposes. A summarization of the FIG. 12 indications appears below the FIG. 12*a* microphotograph in FIG. 12.

FIG. 13 in the drawings includes the views of FIG. 13*a*, FIG. 13*b* and FIG. 13*c*, and shows a contact wear scar and combined Platinum lubricant film and Gold electrode material. A gross lower magnification of the scar area appears in the FIG. 13*a* drawing, while a diagram of the contact lubricant replenishment mechanism occurring in this FIG. 13*a* contact appears in the FIG. 13*b* drawing. In the FIG. 13*c* drawing there appears a quantitative representation of the Platinum and Gold materials used in the contact of FIG. 13. The horizontal scale in FIG. 13*c* represents differing levels of kinetic energy and the lowermost FIG. 13 curve indicates the response of lubricant materials to these different kinetic energy levels while the lubricant is in the non-contacted or original virgin status; the vertical scale in FIG. 13*c* indicates relative lubricant response to these differing energy level excitations of a sample to some arbitrary response magnitude scale.

The recurrent peaks in the uppermost, wear mark related area, of the FIG. 13*c* curves are characteristic of the differing metals appearing in the contact nanoparticle lubricant and electrode, i.e., peaks relating to Gold and Platinum. As indicated by the occurrence of and the energy level location of these metal caused curve peaks the detection of Platinum metal in the Gold wear mark is significant under the represented conditions because such metal was initially present in undetectable quantities in the wear mark region of the represented contact and has migrated into the wear mark following a wear inducing event. The word "Auger" appearing in the FIG. 13*c* data indicates the curves there to be obtained from an Auger spectrometer examination. Such examinations are known in the art and are used to determine near surface properties of a sample such as metal. The Auger process involves impingement of electrons of known energy level on an examined surface and consideration of surface displaced particle energy levels as the output data.

Figures 14, 14A, 14B, 14C, 14D:
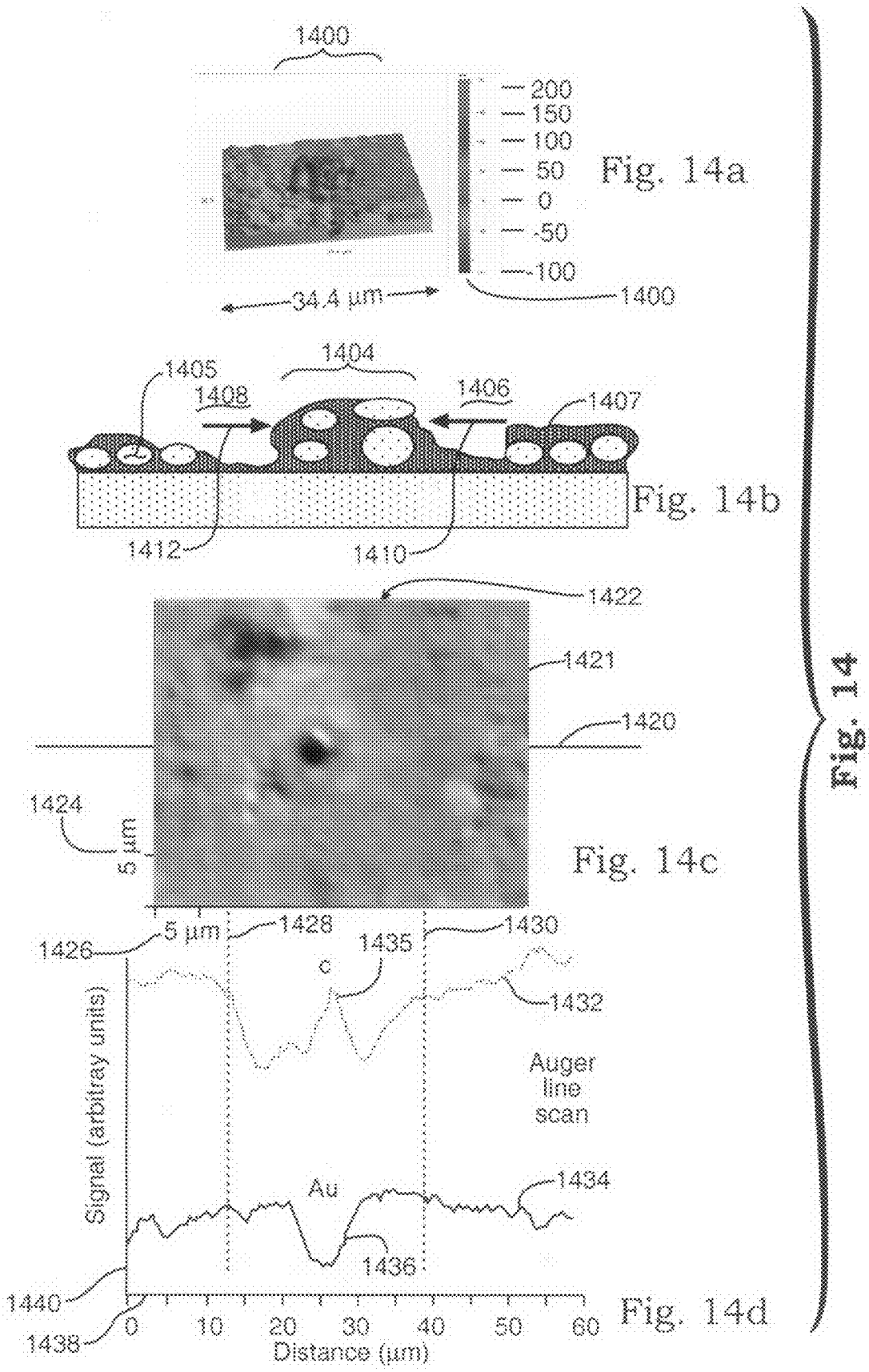
FIG. 14 includes the views of FIG. 14*a*, FIG. 14*b*, FIG. 14*c* and FIG. 14*d*, and shows physical, chemical and quantity details for a nanoparticle lubricated, wafer mounted, MEMS contact wear scar.

FIG. 14 in the drawings includes the views of FIG. 14*a*, FIG. 14*b*, FIG. 14*c* and FIG. 14*d*, and shows both physical details and quantity details attending a Platinum nanoparticles and ionic liquids-lubricated Gold MEMS electrode contact wear scar 1400 in FIG. 14*a*. FIG. 14*a* provides a three-dimensional microphotograph view of the contact wear scar 1400 and its surrounding area including the micrometer dimensioned overall sizes and a nanometer scaled wear scar or raised feature depth gauge 1402. Both an ionic liquid nanoparticle suspension lubricant texture representation and wear scar details also appear in the FIG. 14*a* microphotograph. FIG. 14*b* shows a representative cross-sectional view of a FIG. 14*a* type Gold metal contact having a nanoparticle and ionic liquid film lubricant layer, including a raised central region 1404, as may arise from previous contact wear and arcing. Notably, the nanoparticle and ionic liquid lubricant regions surrounding the raised central region in FIG. 14 are shown as being largely devoid of metallic nanoparticles as a result of the desirable metallic ionic liquid aided nanoparticle migrations toward the disturbed central region 1404; these migrations are represented at 1410 and 1412, as having commenced.

FIGS. 14*c* and 14*d* are related drawings showing a quantitative evaluation of an ionic liquid Platinum nanoparticle lubricated Gold contact area, 1421 as in FIG. 14*a*, and inclusive of a $10^5$ cycles one milliampere achieved central wear mark 1422. A significant component of the FIG. 14*c* and FIG. 14*d* evaluation is the line scan trajectory 1420 across both the lubricated contact area 1421 and the central wear mark 1422. As is indicated in the FIG. 14*d* drawing, this line scan 1420 provides an input signal for an Auger spectrometer apparatus providing measurement of relative amounts of Gold and carbon encountered by the moving spot of the line scan trajectory 1420. The Carbon component in the wear scar 1422 and the surrounding area 1421 is indicated by the curve 1432 and the peak 1435 in the FIG. 14*d* drawing. This detected free Carbon arises from electrical arc induced decomposition of the ionic liquid 1407 in which the Platinum nanoparticles of the FIG. 14 contact are suspended; this ionic liquid may be observed in the formulas relating to the FIG. 6 drawing to include such Carbon as a component material. As indicated by the FIG. 14*d* curve 1434, the wear mark 1422 also is characterized by a reduced amount of Gold in the mark area; this reduced amount is indicated at 1436 in the FIG. 1*d* drawing. FIGS. 14*c* and 14*d* thus provide evidence of lubricant replenishment and migration into the contact zone.

FIG. 15 in the drawings includes the views of FIG. 15*a* and FIG. 15*b*, and shows extended life electrical performance details, i.e., contact electrical resistance magnitudes, for MEMS contacts lubricated in accordance with the present invention. The FIG. 15 drawings provide indications of contact life according to the present invention under both 10 microampere and 1000 microampere or 1 milliampere contact electrical loading in dry nitrogen atmospheres. The FIG. 15 drawings indicate contact performance with ionic lubricant (IL) films and include self assembled monolayer or SAM lubricant performance for comparison purposes. Additional comparison is provided in the FIG. 15 drawings with respect to uncoated contact life and the incorporation of both Platinum and Gold nanoparticle ionic lubricant materials.

Of particular interest in the FIG. 15 drawings is the $10^6$ cycles of operating life at the lower testing 10 microampere current level and the fact that this life is achieved without contact failure or resistance increase occurrences, even at the $10^6$ cycles testing point. Thus since this $10^6$ cycles of life can occur without failure, contact life into at least integer multiples of the $10^6$ cycles, e.g. $5\times10^6$ cycles, or $10^7$ cycles, appears reasonable. The absence of contact shorting (as from the FIG. 12*c* nanowires) at the greater 1000 microampere test current level with a $10^5$ cycles test ending is also a notable features in the FIG. 15 drawings.

With respect to contact resistance related failure mechanisms, it appears significant in FIG. 15 that relatively small contact resistance increases with the 1000 microampere testing current and $10^5$ cycles testing end are experienced during use of the present invention, and that even less contact resistance is encountered at $10^6$ cycles with the FIG. 15*a* 10 microampere testing current. These resistance magnitudes appear of special interest in view of the significantly higher resistances found with fewer testing cycles in instances wherein the present invention is not employed.

We recognize of course in connection with FIG. 15, that MEMS contact life in the $10^9$ operating cycles and longer is desirable and will enable use of such contacts in numerous applications not possible with the FIG. 15 characteristics. The $10^6$ and $10^7$ cycle life times achieved under the FIG. 15 testing conditions are nevertheless believed to be improvements in the MEMS art and, perhaps most importantly, suggestive of evolutionary additional approaches in accordance with the present invention for achieving even longer MEMS contact lifetimes. Nanoparticle liquid lubricants may thus be appreciated as structurally engineered inorganic fluids comprised of nanoparticles with covalently attached ionic organic corona exhibiting softening temperatures between 0° and 100° C. Such nanoparticle fluids are shown herein to provide both desirable contact lubrication and electrical conduction properties and prevent switch shorting and thermal decompositions at higher milliampere switch current levels.

Therefore we have herein disclosed the use of novel liquid nanoparticles as lubricants for MEMS switches. The nanoparticle liquids include nanostructurally engineered inorganic fluids of nanoparticles with covalently attached ionic organic corona that exhibit softening temperatures between 0° and 100° C. The structure of liquid nanoparticle fluid enables hot (under flowing electrical current) switching, where the nanoparticle liquid is an operating component for both contact lubrication and electrical conduction, and prevents switch shorting and thermal decomposition at milliampere current levels. Liquid nanoparticles circumvent two of the primary failure mechanisms of MEMS switches at high currents, e.g. currents of greater than one milliampere, contact melting and contact adhesion or stiction. Desirable electrical conductivity of these materials, as compared to other molecular level lubricants such as organic molecular wires, is a primary contributor to enhanced performance. Gold nanoparticles of about 20 nanometers diameter and an ionic organic corona of Mercaptoethanesulfonate $HSCH_2CH_2SO_3$ and quaternary ammonium $(CH_3)^{+R}{}_3$ where $R=C_{10}-C_{12}$ are examples of the invention realization. The disclosure relates to the use of additional metal and metal alloy nanoparticles and additional ionic organic corona molecular species for MEMS electrical switching devices.

The foregoing description of the preferred embodiment of the present invention has been presented for purposes of illustration and description. It is not intended to be exhaustive or to limit the invention to the precise form disclosed. Obvious modifications or variations are possible in light of the above teachings. The identified embodiment was chosen and described to provide the best illustration of the principles of the invention and its practical application to thereby enable one of ordinary skill in the art to utilize the inventions in various embodiments and with various modifications as are suited to the particular scope of the invention as determined by the appended claims when interpreted in accordance with the breadth to which they are fairly, legally and equitably entitled.

We claim:

1. A nanoparticles lubricant assisted microelectromechanical systems electrical switch, comprising a combination of:

an electrically insulating substrate member;

an electrical circuit connected microelectromechanical systems electrical switch assembly received on said substrate;

said electrical switch assembly including a first movable electrical switch contact element and a second fixed position electrical switch contact element disposed within first movable electrical switch element motion range of said first movable electrical switch contact element; and, an electrically conductive, suspended metallic nanoparticles inclusive, contact lubricant material received intermediate engageable facial portions of said switch assembly first and second electrical contact elements;

said electrically conductive suspended metallic nanoparticles inclusive contact lubricant material including a nanoparticle-attending corona maze of nonmetallic molecules surrounding each of said metallic nanoparticles;

wherein said switch electrically conductive, suspended metallic nanoparticles inclusive contact lubricant material includes a metallic nanoparticle migration enabling ionic corona maze fluid liquid.

2. A nanoparticles lubricant assisted microelectromechanical systems electrical switch, comprising a combination of:

an electrically insulating substrate member;

an electrical circuit connected microelectromechanical systems electrical switch assembly received on said substrate;

said electrical switch assembly including a first movable electrical switch contact element and a second fixed position electrical switch contact element disposed within first movable electrical switch element motion range of said first movable electrical switch contact element; and, an electrically conductive, suspended metallic nanoparticles inclusive, contact lubricant material received intermediate engageable facial portions of said switch assembly first and second electrical contact elements;

said electrically conductive suspended metallic nanoparticles inclusive contact lubricant material including a nanoparticle-attending corona maze of nonmetallic molecules surrounding each of said metallic nanoparticles; and, wherein said nanoparticles and molecules in said attending corona maze of nonmetallic molecules are coupled by a covalent bonding mechanism.

3. A MEMS contact apparatus comprising the combination of:

a first metallic contact member connected with a first node of an electrical circuit and disposed within controlled physical movement distance of;

a second metallic contact connected with a second node of differing electrical potential in said electrical circuit; and a metallic contact lubrication and electrical conduction plasma disposed intermediate said first and second electrical contacts;

said metallic contact lubrication and electrical conduction plasma including a plurality of nanometer sized metallic particles each surrounded by continuously ionized nonmetallic corona bonding with said surrounded nanometer sized metallic particle.

4. The MEMS contact apparatus of claim 3 wherein said continuously ionized nonmetallic corona includes two differing nonmetallic molecules.

5. The MEMS contact apparatus of claim 4 wherein said continuously ionized nonmetallic corona includes a first nonmetallic molecule having covalent bonding with said surrounded nanometer sized metallic particle and a second nonmetallic molecule having ionic bonding with said first nonmetallic molecule.

6. The MEMS contact apparatus of claim 5 wherein said continuously ionized nonmetallic corona includes one of a sulfonate molecule and an ammonium molecule.

7. The MEMS contact apparatus of claim 6 wherein said continuously ionized nonmetallic corona comprises first nonmetallic mercaptoethanesulfonate molecules and second nonmetallic quartneary ammonium molecules.

8. The MEMS contact apparatus of claim 3 wherein said metallic contact lubrication and electrical conduction fluid includes a nanoparticle negative surface charge and ionic coupling of said nanoparticle with a plurality of organic molecules in said fluid.

9. The MEMS contact apparatus of claim 3 wherein said plurality of nanometer sized metallic particles includes plural groups of particles collected into elongated rod shapes.

10. The MEMS contact apparatus of claim 3 wherein said plurality of nanometer sized metallic particles includes plural groups of particles collected into raspberry dumbbell configured shapes.

11. The MEMS contact apparatus of claim 3 wherein said nanometer sized metallic particles comprise one of Gold, Platinum, Silver, Palladium, Rhodium and Ruthenium metal particles.

12. The MEMS contact apparatus of claim 3 wherein said nanometer sized metallic particles have a diameter between one and one hundred nanometers.

* * * * *